United States Patent [19]

Tomaszewski

[11] Patent Number: 4,617,771

[45] Date of Patent: Oct. 21, 1986

[54] MECHANICAL FASTENER FOR ROOFING MEMBRANE AND METHOD OF APPLYING SAME

[75] Inventor: Walter Tomaszewski, Canton, Ohio

[73] Assignee: The Firestone Tire & Rubber Company, Akron, Ohio

[21] Appl. No.: 780,862

[22] Filed: Sep. 26, 1985

[51] Int. Cl.[4] ..... E04D 5/14

[52] U.S. Cl. ..... 52/410; 52/512; 52/741; 24/459

[58] Field of Search ..... 52/506, 512, 222, 273, 52/741, 747, 410; 49/395; 24/459, 460, 462, 461

[56] References Cited

U.S. PATENT DOCUMENTS 3,426,412 2/1969 Streng et al. ..... 24/461

4,502,256 3/1985 Hahn ..... 52/512

*Primary Examiner*—James L. Ridgill, Jr.

*Attorney, Agent, or Firm*—Ernst H. Ruf

[57] ABSTRACT

A non-penetrating mechanical fastener for securing a flexible sheet of an elastomeric material to the upper surface of a roof via the use of a plurality of such fasteners, each of which includes upper and lower members, wherein the latter are anchored to the roofing surface. The upper member includes a snap-ring which clamps the sheet within an annular boss formed on the lower member and a locking cap which is engaged by an interference fit with the snap-ring to lock the ring in position within the boss. A method for securing the flexible sheet to the roofing substrate also is presented.

18 Claims, 6 Drawing Figures

MECHANICAL FASTENER FOR ROOFING MEMBRANE AND METHOD OF APPLYING SAME

TECHNICAL FIELD

The field of art to which this invention pertains is that of mechanical fasteners and particularly to a fastener for mechanically securing a flexible sheet or membrane to the roof without penetrating the membrane and to the method of applying the same.

BACKGROUND ART

A large number of commercial and factory plant roofs are of a flat roof design wherein the roofing material itself is often of a builtup asphalt and in more modern systems of a single ply EPDM elastomeric sheet or membrane. In terms of securing a single ply EPDM membrane to the roof itself, one design utilizes a mechanical ballast system that uses a layer of stone over the membrane. While the ballast system is least expensive it has a disadvantage of being quite heavy (approximately 10 pounds per square foot) thus requiring a heavy roof support structure and in addition the roof slope cannot exceed 10%.

Adhered roof membrane retention systems suffer from the cost penalty while mechanical fasteners and related fastening systems generally require fixation to the roofing substrate via mechanical fasteners. There are two basic kinds of mechanical fasteners namely, membrane penetrating and non-penetrating ones. Each of these types of fasteners has a number of favorable features and each of them is also subject to various drawbacks and disadvantages.

Mechanical fastening systems of the pentrating type generally require fixation to the roofing substrate by a metal fastener with metal or rubberized nailing strips. U.S. Pat. Nos. 4,445,306; 4,074,501; 4,455,804; and 4,467,581 are examples of penetrating type fastening systems in which various rigid and semi-rigid members are used to secure the membrane to the roof. These systems require openings to be formed in the membrane either for receiving a fastening plate or by the attaching anchoring members.

Examples of a non-penetrating type fastener is shown in German Patent Publication 24 33 669 in which the membrane fastener comprises a lower disc which is attached to a roofing substrate by an anchoring member. The roofing membrane is fitted over the lower disc and an upper disc is snapped over the lower disc to perfect the fastening and exert a sealing effect. In another embodiment of this Patent Publication, a plug is driven into the upper disc to expand the body thereof into an annular space provided in the lower disc to anchor the upper disc thereto. Another type of non-penetrating fastening system is shown in U.S. Pat. No. 3,426,412 which has a flexible fastening cover which is snapped over a base member to trap the membrane therebetween. Another embodiment shown in this U.S. patent uses a plug-like member which is snap-fitted into a recess formed in a lower member which is rigidly connected to the roof to trap and clamp the membrane therebetween.

Although both the penetrating and non-penetrating type fastening system do work satisfactory for many applications, it is desirable to have a non-penetrating system for certain applications to eliminate piercing the membrane. Also such a fastener can be installed in a minimum amount of time and without requiring skilled labor, and the fastening element can be securely retained in clamping engagement with the trapped membrane to reduce the accidental disengagement thereof upon the membrane experiencing severe uplift wind forces.

DISCLOSURE OF THE INVENTION

Objectives of the invention include providing an improved mechanical fastener for a roofing membrane and a method of applying the same in which the membrane is secured to the roof without any opening or puncture being imparted into the membrane thereby lessening the possibility of membrane damage during installation; in which a plurality of the fasteners can be placed in various arrangements over the roof surface to provide the required holding power; and in which the fasteners can be installed in a minimum amount of time and in an extremely efficient manner while reducing the possibility of the fasteners being installed incorrectly.

Another object of the invention is to provide such an improved fastener and method in which a lower member of the fastener is rigidly attached to the roof at selected locations with one or more securing anchors after which the membrane is spread over the roof and the attached lower members followed by the subsequent insertion of a snap-ring into the recess of an annular boss formed in each of the lower members which traps and secures the membrane therein; in which a locking cap can be snap-fitted into a recess formed by the trapped snap-ring and membrane to force the snap-ring radially outwardly into a more secure clamping engagement with the membrane than that provided by the natural elasticity of the snap ring; and in which the locking cap covers a pocket formed by the trapped membrane and provides a seal with the membrane to prevent the accumulation of snow, ice and water in the membrane formed pocket.

A still further objective of the invention is to provide such an improved fastener which may be formed out of a rigid lightweight metal such as aluminum, or a rigid plastic material; in which the fastener can be mass produced relatively inexpensively, yet provide an extremely sturdy and durable member which will secure the membrane to the roof and will retain the membrane in the installed position over a considerable period of time without damage to the membrane and which will enable the membrane to withstand the required wind forces without additional ballast, tiedown or fastening members which require the membrane to be pierced. Another objective is to provide such a fastener which can be produced in various sizes and for use with various thicknesses of membranes; in which a limited range of membrane thicknesses can be used with a single type and size of fastener since the membrane can be compressed sufficiently by the cooperating edges of the lower housing snap-ring and locking cap since these components are free of sharp projections; and in which the fastener is able to be used on any flat or irregular roofing geometry such as dome shaped roofs, since the fastener can be placed at various positions on the roof with the flexible membrane conforming to the shape and configuration of the roof.

Still another objective of the invention is to provide such an improved fastener and method for installing the same in which the lower housing component of the fastener may have an external annular flange that is provided with a plurality of anchoring holes or in which the anchoring holes can be formed in a bottom wall of the housing which is located within the interior of an annular boss, which boss is engaged by the snap-ring; in which the snap-ring can be formed of various sizes and elasticity of metal to provide various amounts of clamping action for trapping and securing the membrane within the annular boss of the lower member; and in which the fastener and method provides an extremely inexpensive and efficient device and method of installing the same which achieves the objectives of the invention in a simple, economically and efficient manner.

These objectives and advantages are obtained by the improved mechanical fastener of the invention, the general nature of which may be stated as a fastener for securing a flexible sheet to the upper surface of a roof wherein said fastener includes a rigid housing adapted to be secured to the upper surface of the roof and underlie the elastomeric sheet; fastening means for securing the housing to the upper surface of the roof; an elastic ring mounted in a stressed state on the housing for clamping the elastomeric sheet against the housing; ledge means formed on the housing for retaining the elastic ring in a stressed state on the housing with the elastomeric sheet being clamped between the ring and ledge means; and cap means cap means mounted on the housing by a snap-fit engagement with the elastic ring for locking the ring in clamped engagement with the elastomeric sheet.

These objectives and advantages are further obtained by the improved method of the invention the general nature of which may be stated as a method for mechanically securing an elastomeric sheet to the upper surface of the roof via the use of a plurality of spaced non-penetrating fastening devices, each of said fastening devices includes upper and lower members with said lower member having an upstanding annular boss formed with an undercut circular recess and with said upper member including an elastic snap-ring, a locking cap and anchoring means for securing said lower member to said roof upper surface, wherein said methods comprising the steps of anchoring a plurality of the lower members at spaced locations to the upper surface of the roof; spreading the flexible elastomeric sheet over the roof upper surface and anchored lower members; placing the snap-ring in a stressed condition; installing the snap-ring in the undercut circular recess formed in the annular boss of the lower member to clamp and secure the elastomeric sheet therebetween free of any penetration through said sheet; and engaging the locking cap with the snap-ring with an interference fit to retain the snap-ring in clamping engagement with the elastomeric sheet.

BRIEF DESCRIPTION OF THE DRAWINGS

Preferred embodiments of the invention, illustrative of the best modes in which applicant has contemplated applying the principles are set forth in the following description and are shown in the drawings and are particularly and distinctly pointed out and set forth in the appended claims.

Similar numerals refer to similar parts throughout the drawings.

BEST MODE FOR CARRYING OUT THE INVENTION

Figure 1:
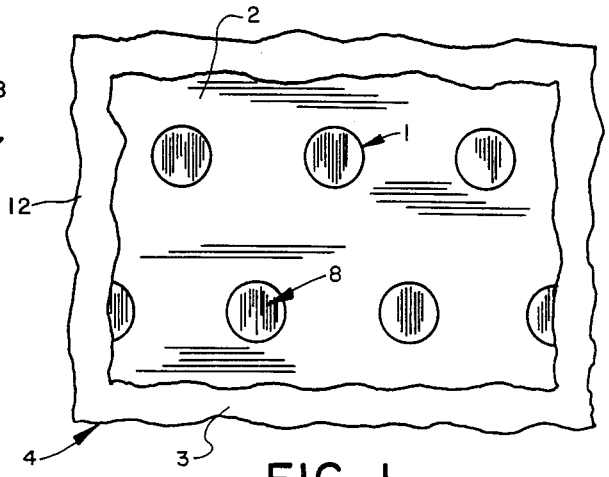
FIG. 1 is a fragmentary, diagrammatic top plan view showing a plurality of the improved mechanical fasteners securing a membrane on a roof.

The improved mechanical fastener is indicated generally at 1, and a plurality of said fasteners are shown in FIG. 1 securing a flexible elastomeric sheet or membrane 2 to upper surface 3 of a roof which is indicated generally at 4. In a typical installation, a plurality of fasteners 1 will be spaced in a predetermined fashion on roof surface 3 such as shown in FIG. 1.

Figure 4:
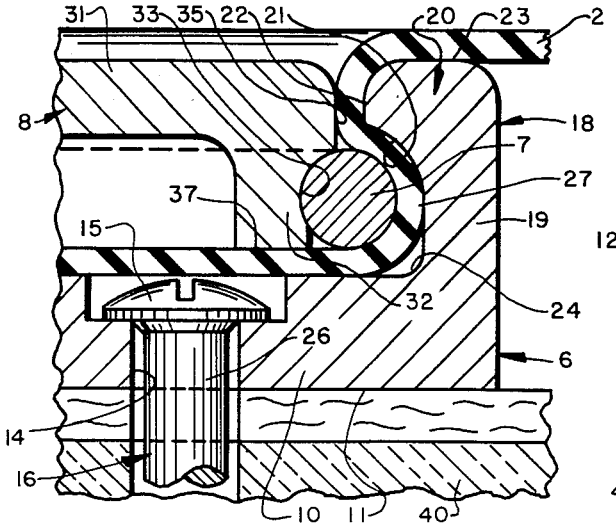
FIG. 4 is an enlarged fragmentary sectional view taken on line 4—4, FIG. 2.
Figure 2:
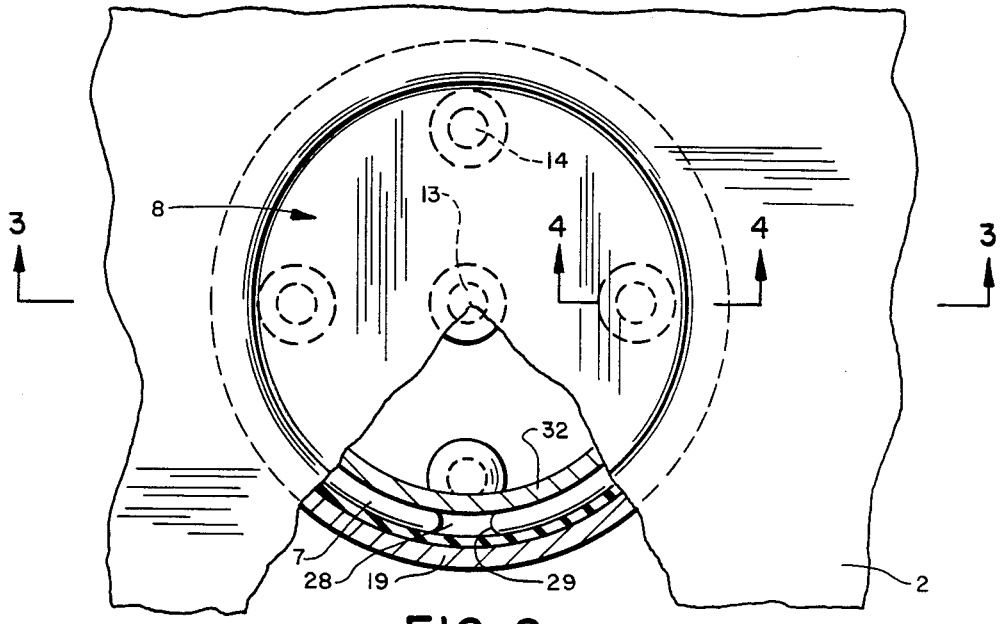
FIG. 2 is an enlarged plan view with portions broken away and in section, of the improved mechanical fastener of FIG. 1.
Figure 3:
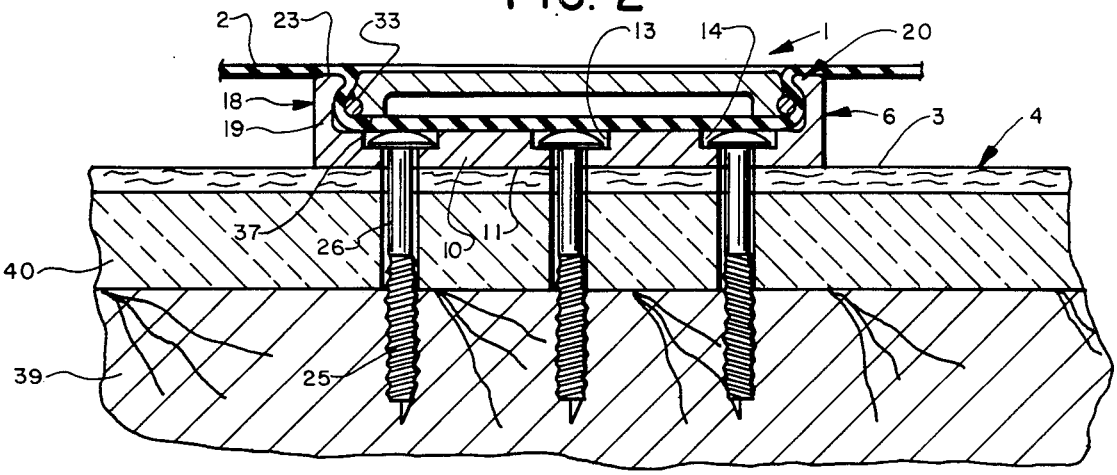
FIG. 3 is a fragmentary sectional view taken on line 3—3, FIG. 2.

Fastener 1 includes a rigid lower member or housing which is indicated generally at 6, an elastic snap-ring 7 and a locking cap indicated generally at 8. Referring to FIGS. 2, 3 and 4, housing 6 has an annular configuration with a disc-shaped bottom wall 10 having a circular flat bottom surface 11 which is adapted to lay flush against a top panel 12 of roof 4. Bottom wall 10 is formed with a central hole 13 and a plurality of circularly arranged spaced holes 14. Holes 13 and 14 are countersunk as shown in FIG. 3, so as to receive head 15 of an anchoring device which is indicated generally at 16.

An annular-shaped boss indicated generally at 18, is formed integrally with bottom wall 10 and extends axially therefrom. Boss 18 includes an annular wall 19 having a smooth outer surface and a top annular ledge 20 formed with an undercut circular recess 21. Ledge 20 is connected with recess 21 by a smooth generally curved annular surface 22. Ledge 20 futher includes a flat horizontally extending smooth top edge 23 with recess 21 being connected to bottom wall 10 by a vertical wall section 27 and a smooth curved radial surface 24. Anchoring devices 16 are of a usual construction, preferably having lower threaded ends 25 and smooth upper shanks 26. The number of anchoring devices 16 will vary depending upon the particular roofing installation and for certain applications only a single anchor may be required through central hole 13 or several anchors may be inserted through certain of holes 14. The plurality and different locations of holes 13 and 14 insures that housing 6 will always be securely attached to the roof even though one of the anchoring devices could enter a void in the roof or hit a nonpenetrating portion of the roof.

Snap-ring 7 has a circular configuration and is formed of an elastic spring metal material and is circular in cross section as shown in FIG. 3. A gap 28 is formed at one location in ring 7 with separated gap ends 29 having rounded configurations so as to be free of sharp points which could cut into the membrane. When in an unstressed or uncompressed condition, ring 7 will have an outer diameter generally equal to the internal diameter of recess 21 and in particular generally equal to the inner diameter of vertical wall 27, less twice the thickness of membrane 2. This will insure that ring 7 will be retained beneath ledge 20 without excessively clamping membrane 2 into recess 21. Gap 28 must be sufficiently large so that the circumference of the ring when in a compressed state with ends 29 touching must be less than the circumference defined by the outer annular surfaces 22 of ledge 20 less twice the thickness of membrane 2 to enable the ring to be inserted within annular wall 19 of housing boss 18 after which it can expand outwardly into recess 21 as shown in FIG. 3 to clamp membrane 2 securely therein.

Locking cap 8 includes a disc-shaped top wall 31 and an annular axially extending peripheral flange 32. Flange 32 is formed with an undercut circular recess 33 in the outer surface thereof. Recess 33 has a diameter equal to and preferably greater than the inside diameter of snap-ring 7 when the ring is in an unstressed condition. Cap recess 33 is connected with the smooth top surface of top wall 31 by a generally flat smooth annular outer edge 35. Edge 35 has a diameter generally equal to the diameter defined by annular surface 22 of ledge 20 minus twice the thickness of membrane 2 so as to form a tight seal therewith when cap 8 is in an installed position as shown in FIG. 3. Annular bottom edge 37 of cap flange 32 has a smooth surface to eliminate any sharp edges which could cut into membrane 2.

As shown in FIG. 3, housing 6 is secured by one or more anchoring devices 16 which can be screws, nails, expansion bolts, or the like into a main roof deck 39 so as to be firmly secured thereto. Roof 4 may also include a sheet 40 of insulation covered by top panel 12. A plurality of housings 6 are placed in a spaced relationship throughout the roof top surface 3. The number of housings 6 and their location will depend upon the size of fasteners 1, the thickness and size of membrane 2, the particular construction of roof 4, and the particular wind loads to which the membrane is designed to withstand. After the housings are rigidly secured to the roof, membrane 2 is laid over the installed housings and workmen will install a snap-ring 7 at each housing location. Snap-rings 7 can be installed manually or with a tool by placing the ring in a compressed position wherein rounded ends 29 preferably will be touching. The compressed ring is then inserted into the interior of annular boss 18 pressing part of the membrane 2 into the boss. Ring 7 then is permitted to expand outwardly into undercut circular recess 21 clamping membrane 2 into the recess. The adjacent membrane portions will curve upwardly around ledge 20 and continue generally horizontally therefrom as shown in FIG. 3.

Next, a locking cap 8 is snap-fitted into each of the circular pockets formed within bosses 18 by clamped membrane 2. Due to the particular diameter of cap recess 33, it forms an interference fit with ring 7 and presses ring 7 into clamping engagement with the trapped portion of membrane 2 located in housing recess 21. Cap 8 also provides a seal with membrane 2 adjacent ledge 20 preventing water from entering the pocket formed by trapped membrane 2 and mainly prevents accidental disengagement of snap-ring 7 from its clamped position within housing recess 21 upon the membrane experiencing strong uplifting wind forces. Preferably the top surface of cap 8 is generally parallel with the top surface of membrane 2 to provide a generally continuous smooth surface preventing the accumulation of water at each of the fastener locations.

In accordance with one of the main features of the invention, improved fastener 1 does not require any holes or other openings to be formed in membrane 2 for securing it to the roof as in prior penetrating fastening systems. The smooth edges and curved undercut recess and flat bottom surface of housing 6 and the smooth edge of ledge 20, ledge edge surface 22 and cap edge 35 eliminate any sharp corners or protrusions which could pierce and damage the membrane. Also, bottom annular edge 37 of locking cap 8 retains an annular portion of membrane 2 against housing bottom wall 10. Thus, no openings or holes are created in the membrane which would require sealing and which could be subject to leakage over extended periods of time as in penetrating type fastening systems.

In terms of the method process for utilizing non-penetrating fastener 1, a plurality of housings 6 are secured to roof 4 by anchor devices 16 after which membrane 2 is layed over the roof and housings. Snap-rings 7 then are installed at housing locations to securely clamp the membrane to the housings after which locking caps 8 are installed at each housing location. The location of each housing will be readily detected by a slight upward bulge of the membrane at the housing location and a workman can easily feel the recess within the housing for installing snap-ring 7 manually or with an appropriate installation tool. As discussed above, in installing housings 6, one or more anchoring means may be used depending upon the structure of the roof and particular roof covering application. The plurality of holes spaced throughout bottom wall 10 generally insures that at least one anchor will provide a firm engagement with the roof for securing the housing thereto. Housing 6 and locking cap 8 preferably are made of a rigid lightweight material such as aluminum, as indicated in FIGS. 2 and 3 of the drawings or can be formed of a rigid plastic material.

Figure 5:
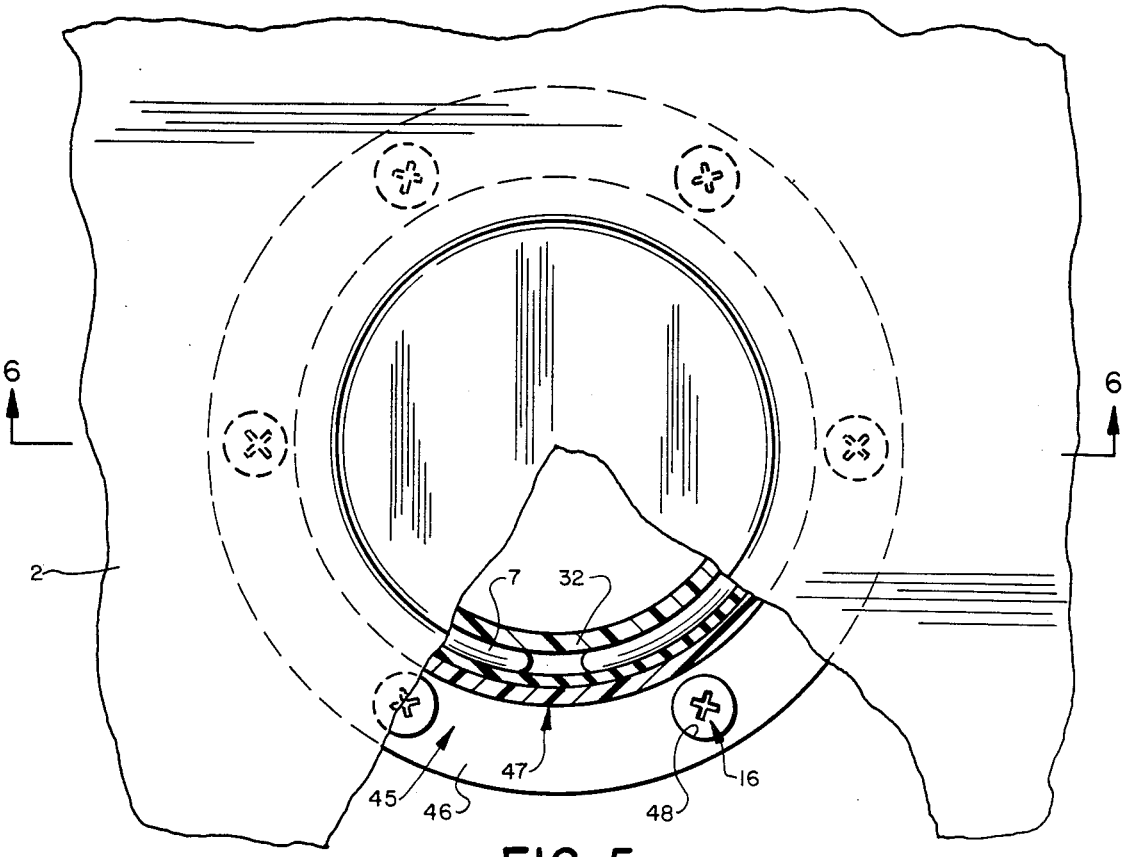
FIG. 5 is a fragmentary top plan view with portions broken away and in section, similar to FIG. 2 showing a second embodiment of the improved mechanical fastener.
Figure 6:
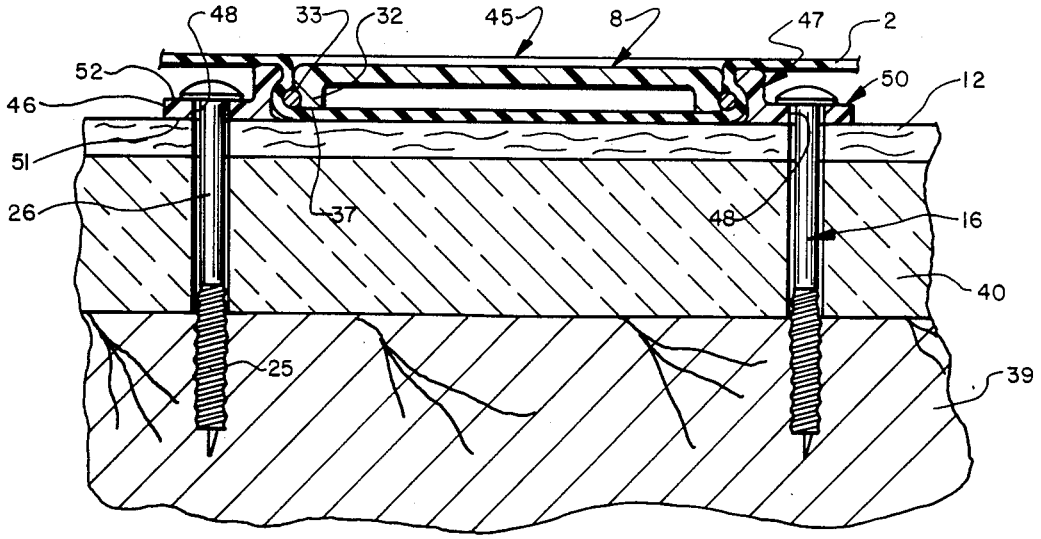
FIG. 6 is a fragmentary sectional view taken on line 6—6, FIG. 5.

A modified form of the improved fastener is indicated generally at 45 and is shown in FIGS. 5 and 6. The only difference between fastener 45 and fastener 1 is that disc-shaped bottom wall 10 of housing 6 has been eliminated and replaced by an outer annular flange 46 of a modified housing 50, which flange extends radially outwardly with respect to an annular boss 47 which is similar to boss 18 of fastener 1. A plurality of mounting holes 48 are formed in flange 46 and are spaced circumferentially thereabout for receiving anchoring devices 16 or other fastening means. Holes 48 need not be countersunk as are attachment holes 13 and 14 of fastener 1 since clearance is not required from membrane 2 as in fastener 1.

Locking cap 8 and the particular configuration of annular boss 47 is the same as that described above with respect to fastener 1 and therefore need not be described in further detail. Bottom annular edge 37 of cap 8 will hold an annular portion of membrane 2 against roof panel 12 as shown in FIG. 6 instead of retaining it against the top surface of housing bottom wall 10. However, the clamping action of snap-ring 7 and end cap 8 are the same as in fastener 1.

When mounting modified housing 50 on roof 4, preferably two or more anchor devices are used to securely attach housing 50 to the roof and prevent any pivotal movement thereof which could occur if it were attached with only a single anchor. The particular method of installing fastener 45 is the same as previously described with respect to fastener 1. Fastener 45 is shown in the drawings as being formed of plastic instead of the aluminum as illustrated in FIGS. 2 and 3 for fastener 1. However, fasteners 1 and 45 can be formed either of metal, plastic or similar rigid material without affecting the concept of the invention. Fastener 1 is shown as metal and fastener 45 is being shown of plastic for illustrative purposes only. Flange 46 of housing 50 preferably has a flat annular bottom wall 51 and a flat top wall 52 with bottom wall 51 permitting the housing to lie flat against the top surface of roof panel 12 as does bottom surface 11 of fastener 1.

The actual dimensions of fasteners 1 and 45 including the individual components thereof, can vary depending upon the wind lift requirements at the installation site and the size and thickness of membrane 2 to be secured thereby. In a typical installation, membrane 2 will have a thickness in the range of 0.045 to 0.060 inches and locking cap 8 will have a outer diameter of approximately 2.8 inches, snap-ring 7 will have an unstressed diameter of approximately 3.035 inches, with a gap separation of approximately 0.375 inches with the outer diameter of annular flange 46 of fastener 45 being 4.57 inches. The above figures are for illustrative purposes only and it is readily understood by anyone skilled in the art that these dimensions can vary depending upon the particular installation without affecting the concept of the invention.

Non-penetrating fasteners 1 and 45 and the method of installation has a number of advantages over prior art fasteners, especially the penetrating type of fastener. When a membrane is pierced, it can result in a problem area in the roof membrane especially after the membrane has been installed for a number of years. Also, fastener housings 6 and 50 are provided with a plurality of mounting holes insuring that each fastener housing can be rigidly secured to the roof even though void areas are located under certain portions of the housings. Also, the amount of clamping force exerted by snap-ring 7 against membrane 2 can be varied by changing the characteristics of the elasticity of the ring as well as its size with respect to the diameter of the undercut circular recess of the boss in addition to changing the external diameter of the undercut recess in the locking cap. Locking cap 8 increases the clamping action of the snap-ring against the membrane and mainly reduces the possibility of the snap-ring becoming disengaged from its clamped position with the membrane. Cap 8 also prevents the accumulation of water, ice and snow within the pocket formed by the membrane when in clamped position within the fastener boss. Ring 7 need not clamp membrane 2 excessively tight against vertical wall portion 27 but expands sufficiently outwardly beneath ledge 20 to prevent it from becoming dislodged therefrom.

The improved fastener is suitable for flat roofs as well as spherical roofs and also requires no additional sealants as in prior fastening systems. The improved non-penetrating fastener also is believed to be an advantage over prior non-penetrating fasteners since it replaces the heretofore expanding plug with a locking ring which is believed to be more securely retained within the undercut recess of the associated component housing and therefore less acceptible to dislodging upon uplifting wind forces being exerted on the membrane. Furthermore, the locking ring is a readily available and easily obtained component and can have various characteristics such as its elasticity and size to correspond to various roof installations.

Accordingly, the improved fastener is simplified, provides an effective, safe, inexpensive, and efficient device and associated mehtod which achieves all the enumerated objectives, provides for eliminating difficulties encountered with prior fastening devices and methods, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is be way of example, and the scope of the invention is not limited to the exact details shown or described.

Having now described the features, discoveries, and principles of the invention, the manner in which the improved mechanical fastener for securing a flexible membrane to the upper surface of a roof is constructed and used, the characteristics of the construction, and the advantageous, new and useful results obtained; the new and useful structures, devices, elements, arrangements, parts, combinations and method steps for installing the same are set forth in the appended claims.

What is claimed is:

1. A mechanical fastener securing a flexible elastomeric sheet to the upper surface of a roof, said fastener including:

(a) a rigid housing secured to the upper surface of the roof and underlying the elastomeric sheet, said housing having an upstanding annular-shaped boss with an annular-shaped ledge formed integrally with and extending radially inwardly from said boss to form an undercut circular recess;

(b) fastening means securing the housing to the upper surface of the roof;

(c) a separate elastic ring split at one location on its circumference mounted within the annular-shaped boss of the housing clamping the elastomeric sheet against the housing in the undercut circular recess between the elastic ring and ledge; and (d) a locking cap mounted on the housing by a snap-fit engagement, said cap having an annular-shaped side wall, with an undercut recess formed in an outer surface of said wall, said recess having a diameter at least equal to or greater than the unstressed diameter of the elastic ring, said cap side wall being inserted within the annular-shaped wall of the housing and engaging the elastic ring within the undercut recess of the cap, thus maintaining said ring in clamping engagement with the elastomeric sheet and within the undercut circular recess of the housing.

2. The mechanical fastener defined in claim 1 in which the unstressed diameter of the elastic ring is generally equal to the diameter of the undercut circular recess less twice the thickness of the elastomeric sheet in order to clamp said sheet between the ring and recess.

3. The mechanical fastener defined in claim 1 in which the housing includes an outer annular peripheral flange formed with a plurality of circumferentially spaced holes; in which the fastening means is a plurality of rigid anchors each of which has a head and a shank; and in which the anchor shanks extend through the holes to secure the housing to the roof.

4. The mechanical fastener defined in claim 1 in which the locking cap includes a disc-shaped top wall having a peripheral edge; in which said peripheral edge is a smooth annular surface which presses the elastomeric sheet against the ledge.

5. The mechanical fastener defined in claim 1 in which the annular side wall of the locking cap has a height generally equal to the height of the housing boss.

6. The mechanical fastener defined in claim 1 in which the cap means and housing are formed of aluminum.

7. The mechanical fastener defined in claim 1 in which the locking cap and housing are formed of plastic.

8. The mechanical fastener defined in claim 1 in which the housing has a disc-shaped bottom wall with the annular-shaped boss being formed integrally with the bottom wall adjacent the periphery thereof; and in which opening means is formed in the bottom wall for receiving the fastening means therein for securing the housing to the roof.

9. The mechanical fastener defined in claim 8 in which the opening means includes a central hole and a plurality of circular spaced holes located radially inwardly from and generally adjacent to the boss.

10. The mechanical fastener defined in claim 9 in which the opening means holes are countersunk in the bottom wall of the housing.

11. The mechanical fastener defined in claim 9 in which the bottom wall of the housing has a flat bottom surface.

12. A method for mechanically securing a flexible elastomeric sheet to the upper surface of a roof via the use of a plurality of spaced non-penetrating fastening devices, each of said fastening devices includes upper and lower members with said lower member having an upstanding annular boss with an annular-shaped ledge formed integrally with and extending radially inwardly from said boss forming an undercut circular recess and with said upper member including an elastic ring split at one location on its circumference and a locking cap having an annular-shaped side wall with an undercut recess, and anchoring means for securing said lower member to said roof upper surface, said method comprising the steps of:

(a) anchoring a plurality of the lower members at spaced locations to the upper surface of the roof;

(b) spreading the flexible elastomeric sheet over the roof surface and anchored lower members;

(c) placing the elastic ring in a stressed condition by reducing the size of the split and correspondingly the diameter of the ring;

(d) installing the ring in the undercut circular recess formed in the annular boss of the lower member clamping and securing the elastomeric sheet therebetween as the ring attempts to expand outwardly to its unstressed state with said sheet being free of any penetration therethrough by the ring; and (e) engaging the locking cap with the elastic ring by a snap-fit engagement with the elastic ring entering the undercut recess in the side wall of the locking cap to retain the ring in clamping engagement with the elastomeric sheet.

13. The method defined in claim 12 wherein the diameter of the circular recess of the locking cap is larger than the internal diameter of the ring in an unstressed condition for expanding the ring outwardly into clamping engagement with the elastomeric sheet.

14. The method defined in claim 12 in which the elastic ring has a circular cross-sectional configuration.

15. The method defined in claim 12 in which the outer diameter of the elastic ring, when placed in the stressed condition, has an outer diameter equal to or less than the diameter of the circular undercut recess of the lower member less twice the thickness of the elastomeric sheet.

16. The method defined in claim 12 wherein the anchoring step includes passing anchors through holes formed in a flat bottom wall of the lower member and into the upper surface of the roof.

17. The method defined in claim 16 in which the flat bottom wall of the lower member is an annular flange extending radially outwardly from the annular boss.

18. The method defined in claim 16 in which the flat bottom wall of the lower member is a disc-shaped wall located within the annular boss.

* * * * *